United States Patent [19]

Austin, Jr.

[11] 4,216,864

[45] Aug. 12, 1980

[54] CONTAINER WITH AN INTEGRALLY FORMED SPOUT AND BLANK THEREFOR

[75] Inventor: John J. Austin, Jr., Hinsdale, Ill.

[73] Assignee: Champion International Corporation, Stamford, Conn.

[21] Appl. No.: 15,225

[22] Filed: Feb. 26, 1979

[51] Int. Cl.[2] ..... B65D 5/74; B65D 17/24

[52] U.S. Cl. ..... 206/622; 229/17 R

[58] Field of Search ..... 229/7 R, 17 R; 206/622

[56] References Cited

U.S. PATENT DOCUMENTS

| | | | |
|---|---|---|---|
| 1,704,987 | 3/1929 | Marsh | 229/17 R |
| 2,313,987 | 3/1943 | Buttery | 229/17 R |
| 2,345,978 | 4/1944 | Hultin | 229/17 R |
| 2,349,362 | 5/1944 | Marshall | 229/17 R |
| 2,364,364 | 12/1944 | Hultin | 229/17 R |
| 2,417,498 | 3/1947 | Hultin | 229/17 R X |
| 2,974,845 | 3/1961 | Struble | 229/17 R |

FOREIGN PATENT DOCUMENTS

| | | | |
|---|---|---|---|
| 636897 | 5/1950 | United Kingdom | 229/17 R |

*Primary Examiner*—Stephen P. Garbe

*Attorney, Agent, or Firm*—Evelyn M. Sommer

[57] ABSTRACT

A multi-sided container, preferably formed of a unitary blank of paperboard, having two adjacent top closure flaps which are connected by a fold line and which have fold lines and frangible perforated lines therein to define three hingedly connected, superimposed triangular areas. Upon severance of these perforated lines, the three triangular areas are pulled away from the container to unfold them from their superimposed position, thereby forming the spout. A third top closure flap is also provided, which flap has a fourth triangular area that is superimposed on the top of the other three.

25 Claims, 12 Drawing Figures

CONTAINER WITH AN INTEGRALLY FORMED SPOUT AND BLANK THEREFOR

The present invention relates to a container, formed of a unitary blank of paperboard or cardboard, having a pour spout integrally formed therein which can be easily opened and closed to selectively pour the contents of the container therefrom. The invention also relates to the configuration of the unitary blank forming the container.

There are presently on the market numerous containers or cartons formed of paperboard or cardboard which contain granular or powdered products in which a pour spout is provided. These pour spouts can be formed in various different ways. One is the provision of a metallic spout which is hingedly added to the carton. However, this type of spout is expensive to manufacture and requires the additional manufacturing step of combining the metal spout with the cardboard container. A second way of forming a spout includes extra internal panels in the cardboard container which increases the cost of materials for the container and usually prevents a high speed production of the finished product. A third type of spout includes a separate piece of cardboard which requires a secondary operation to fit that piece to the container. In addition to these drawbacks, the prior art spouts are usually hard to open and difficult to securely close and safely prevent inadvertent spillage of the contents of the container.

Accordingly, it is a main object of the present invention to overcome the limitations and drawbacks associated with the prior art container spouts set forth above and to provide a new and improved container with an integral pour spout therein.

Another object of the present invention is to provide a container having an integral pour spout in which the container is formed from a unitary blank of material, such as paperboard or cardboard.

Another object of the present invention is to provide a container having an integral pour spout in which the container is economically produced with a minimum amount of material and which can be formed, loaded and closed at a high production speed using automated methods.

Another object of the present invention is to provide a container with a pour spout which is easily opened and is easily closed in a secure fashion to prevent inadvertent spillage of the material inside the container.

The foregoing objects are basically attained by providing a container comprising a front panel, two side panels and a rear panel connected along generally parallel fold lines to provide a multi-sided body; a glue flap interconnecting two of the panels; a bottom closure for the body connected to at least one of the panels; first and second top closure flaps hingedly extending respectively along fold lines from the tops of two adjacent panels and extending perpendicular to the two adjacent panels; the top closure flaps being intergrally formed and having a fold line therebetween; and means, in said top closure flaps, defining three hingedly connected, superimposed triangular areas, the means including a first frangible perforated line in the first top closure flap and a second frangible perforated line in the second top closure flap, these triangular areas forming the spout once the frangible perforated lines are severed and the triangular areas are pulled outwardly from the multi-sided body.

More specifically, a first triangular area is located in the top closure flap associated with the front panel and is defined by the fold line between the first and second top closure flaps, the first frangible perforated line and a fold line extending from a corner of the first top closure flap. This triangular area is in substantially the form of a right, isosceles triangle.

The second and third triangular areas are located in the top closure flap associated with one of the side panels wherein the first of these triangular areas is defined by a top edge of the top closure flap, the fold line between the first and second top closure flaps and a diagonal fold line extending from a corner of the second top closure flap. The second of these triangular areas in the second top closure flap is defined by the diagonal fold line, the fold line separating the top closure flap and the side panel and a perforated line extending from that fold line. These two triangles are also substantially right, isosceles triangles.

These three triangular areas all enclose the same area and have the same configuration.

In addition, a third top closure flap hingedly extends along a fold line from the top of the rear panel and overlies the top closure flap extending from the front panel. This third top closure flap has a fourth triangular area defined therein by an edge thereof, a perforated line and a fold line extending from a corner thereof, which triangular area is superimposed over the three other triangular areas once the container is formed. This fourth triangular area aids in reinforcing the spout which is formed and aids in making sure the spout stays closed once it is manipulated into the closed position.

Other objects, advantages and salient features of the present invention will become apparent from the following detailed description, which, taken in conjunction with the annexed drawings, discloses a preferred embodiment of the present invention.

Referring to the drawings which form a part of this original disclosure:

Figure 3:
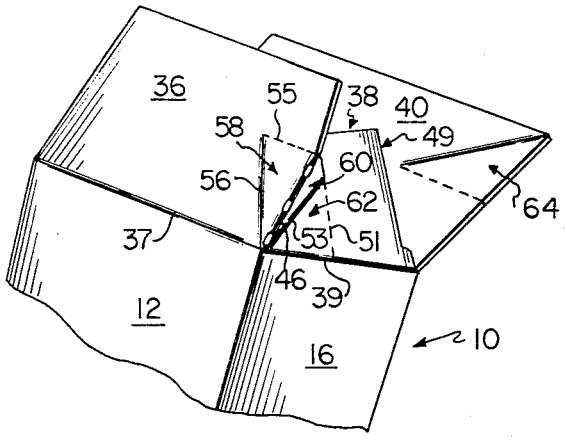
FIG. 3 is a fragmentary left perspective view in front elevation of the top closure flaps as the side panel top closure flap is being folded inwardly and as the front panel top closure flap is also being folded inwardly.
Figure 4:
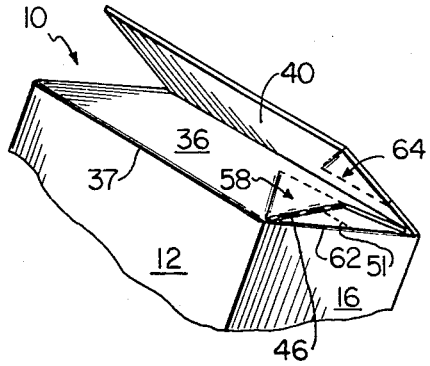
Figure 5:
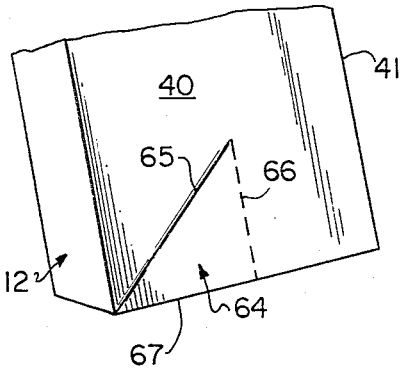
Figure 6:
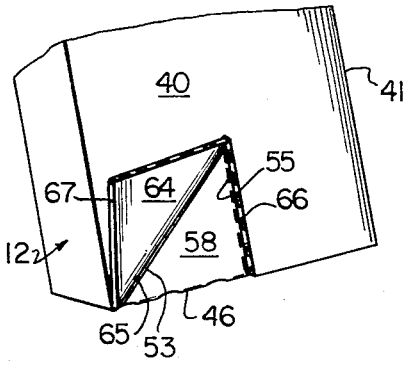
Figure 7:
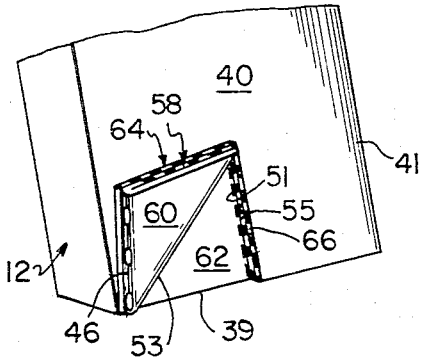
Figure 8:
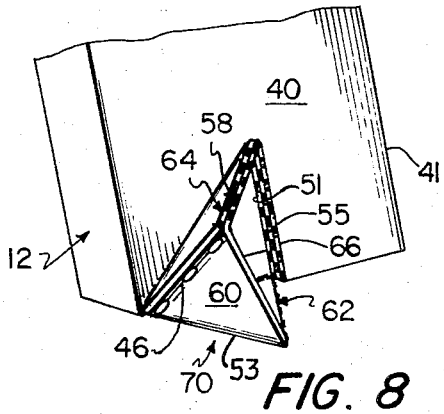
Figure 9:
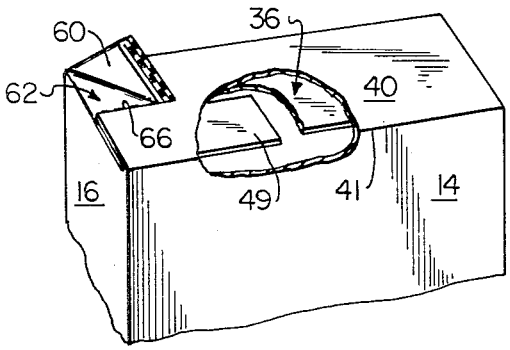
Figure 10:
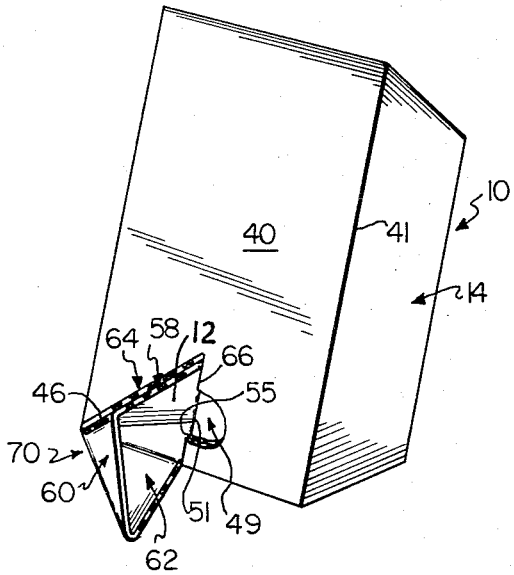
Figure 11:
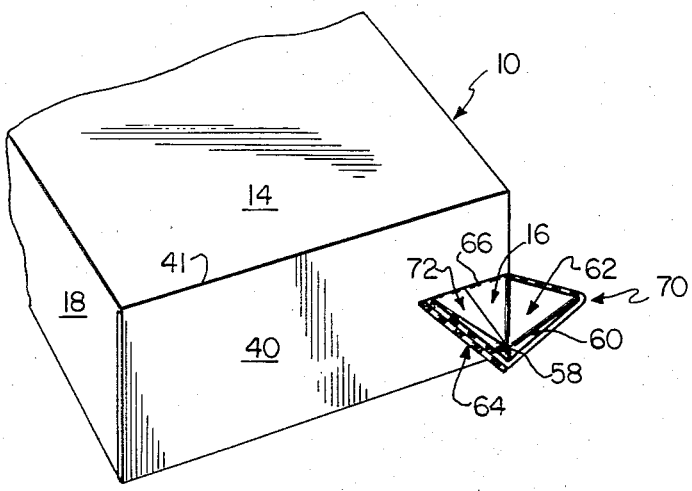
Figure 12:
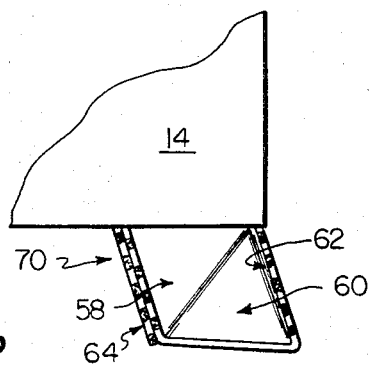

FIG. 4 is a fragmentary left perspective view in front elevation of the container with the top closure flaps in a more advanced inwardly folded position than that shown in FIG. 3, wherein the side panel top closure flap is substantially perpendicular to the side panel, the front panel top closure flap is substantially perpendicular to the front panel and the rear panel top closure flap is about to be folded over onto the front panel top closure flap;

FIG. 5 is a fragmentary left perspective view of the top of the container in its closed position;

FIG. 6 is a fragmentary left perspective view of the top of the container in which the triangular area on the rear panel top closure flap has been severed along the perforated line therein and folded back along the fold line therein;

FIG. 7 is a fragmentary left perspective view of the top of the container in which the triangular area on the front panel top closure flap and one of the triangular areas on the side panel top closure flap have been folded along their respective fold lines, with simultaneous severing of the perforated line in the front panel top closure flap, to a position contacting the previously folded triangular area from the rear panel top closure flap;

FIG. 8 is a fragmentary left perspective view of the top of the container in which the perforated line in the second triangular area on the side panel top closure flap has been severed and the triangular area adjacent thereto has been pulled outwardly from the container to fully open the spout;

FIG. 9 is a fragmentary right perspective view in front elevation of the container with portions cut away, showing the status of the opening spout, which is the same as the stage shown in FIG. 7;

FIG. 10 is a right perspective view of the top of the container, with parts broken away, showing the opened spout from a view slightly different from that shown in FIG. 8;

FIG. 11 is a fragmentary left perspective view of the opened spout showing the various parts thereof; and FIG. 12 is a top plan fragmentary view of the opened spout on the container.

Figure 1:
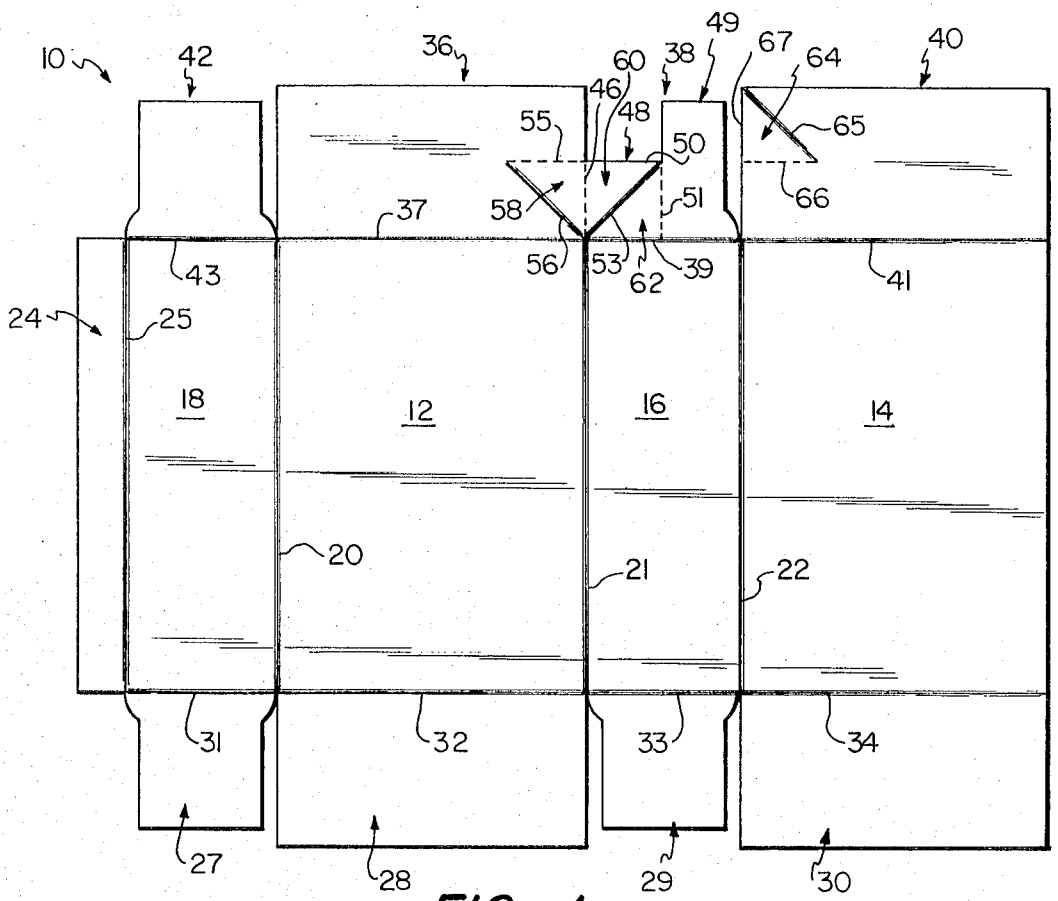
FIG. 1 is a top plan view of the unitary blank adapted to form the container of the present invention in which the interior solid lines represnt hingeable or fold lines and the dashed lines indicate perforated lines.

Referring now to the drawings in further detail, the unitary blank 10 shown in FIG. 1 is preferably formed of thin, foldable paperboard but can also be formed of thin, foldable cardboard. The blank 10 is comprised of a front panel 12, a rear panel 14, a first side panel 16 and a second side panel 18, all of which are rectangular and are hingedly connected respectively along parallel fold or hinge lines 20, 21 and 22. These fold lines are preferably formed in the paperboard blank 10 by means of a light scoring of the paperboard. In addition, a glue flap 24, which can have adhesive thereon, hingedly extends along fold line 25 from the distal edge of the second side panel 18. Of course, this glue flap could also extend from the distal or exterior edge of the rear panel 14 shown in FIG. 1. Panels 12, 14, 16 and 18 have the same length.

The first side panel 16 and the second side panel 18 are on opposed sides on the front panel 12, the sides being defined by fold lines 20 and 21. The second side panel 18 is interposed between the glue flap 24 and the front panel 12. The rear panel 14 hingedly extends along fold line 22 from the first side panel 16. The width and length of the two side panels are the same and the width and length of the front and rear panels are the same. The width of each side panel is about one-half the width of the front and rear panels.

At the bottom of these four panels is a bottom closure formed from four bottom closure flaps 27, 28, 29 and 30. The first bottom closure flap 27 hingedly extends along fold line 31 from the bottom of the second side panel 18. The second bottom closure flap 28 hingedly extends along fold line 32 from the bottom of the front panel 12. The third bottom closure flap 29 hingedly extends along fold line 33 from the bottom of the first side panel 16. And, the fourth bottom closure flap 30 hingedly extends along fold line 34 from the bottom of the rear panel 14.

A top closure is formed from four top closure flaps extending from the tops of the panels. The first top closure flap 36 hingedly extends along fold line 37 from the top of the front panel 12. The second top closure flap 38 hingedly extends along fold line 39 from the top of the first side panel 16. The third top closure flap 40 hingedly extends along fold line 41 from the top of the rear side panel 14. And, the fourth top closure flap 42 hingedly extends along fold line 43 from the top of the second side panel 18. Preferably, these fold lines are perpendicular to the fold lines between the various panels. A similar orientation of the fold lines regarding the bottom closure flaps is present as seen in FIG. 1.

As seen in FIG. 1, preferably the top and bottom closure flaps associated with the front and rear panels, except for the second top closure flap 38, are substantially rectangular in shape and have a width substantially equal to the width of the panels. Their length is substantially equal to the width of the side panels. The four top and bottom closure flaps associated with the side panels, except for the second top closure flap 38, have a width which tapers and have a length somewhat shorter than the length of each of the flaps associated with the front and rear panels.

As seen in FIG. 1, the second top closure flap 38 has a configuration which is different from the other top and bottom closure flaps. Specifically, the second top closure flap 38 is integrally formed with the first top closure flap 36 and has a fold line 46 therebetween. This fold line is preferably perforated so as to provide especially easy hinging along that line, although it is not intended that this line be severed.

The second top closure flap 38 is comprised of a first portion 48 and a second portion 49, these portions having slightly different widths with the width of the first portion being slightly larger than the width of the second portion. The length of the second portion is preferably about twice the length of the first portion and about the same as the length of the other closure flaps. Extending down the center of the second top closure flap 38 from the top edge 50 of the first portion 48 to the fold line 39 is a frangible perforated line 51, which is parallel to the fold line 46 between the first and second top closure flaps 36 and 38. A diagonal fold line 53 extends across the first portion 48 of the second top closure flap 38 and intersects at one end with the intersection of fold lines 39 and 46 and intersects at the other end with the intersection of top edge 50 and perforated line 51.

The first top closure flap 36 has a frangible perforated line 55 extending inwardly from the righthand edge of that flap in the middle of the flap and in contact with the top of fold line 46. A fold 56 line also in flap 36 extends from the bottom of fold line 46 to the end of perforated line 55.

Thus, the first and second top closure flaps 36 and 38 define three hingedly connected, triangular areas by means of the various fold and perforated lines described above. As to be described in more detail hereinafter, when the container is formed from the blank, these three triangular areas are in superimposed relationship.

Specifically, a first triangular area 58 is defined in the first top closure flap 36 by fold lines 56 and 46 and perforated line 55. This triangular area is in substantially the form of a right, isosceles triangle with the angle between lines 55 and 46 being about 90 degrees, the angle between lines 55 and 56 being about 45 degrees and the angle between lines 46 and 56 being about 45 degrees.

As seen in FIG. 1, a second triangular area 60 and a third triangular area 62 are both defined in the second top closure flap 38. Specifically, triangular area 60 is defined by the top edge 50 of the first portion 48, the fold line 53 and the fold line 46.

The third triangular area 62 is defined by the fold line 53, the perforated line 51 and the fold line 39. Each of these triangular areas in the second top closure flap 38 is in substantially the form of a right, isosceles triangle, with fold line 53 forming the hypotenuse of each of these triangular areas. The angle between lines 51 and 39 is about 90 degrees, the angle between lines 53 and 39 is about 45 degrees and the angle between lines 51 and 53 is about 45 degrees. Similarly, the angle between line 46 and top edge 50 is about 90 degrees, the angle between top edge 50 and line 53 is about 45 degrees, and the angle between line 46 and line 53 is about 45 degrees.

As will be described hereinafter in more detail, these three triangular areas 58, 60 and 62 ultimately form the pour spout for the container.

Referring now to the third top closure flap 40 extending from the rear panel 14, it is seen that a fourth triangular area 64 is defined in the upper lefthand corner adjacent the second top closure flap 38. This triangular area is formed on its left by the left edge 67 of the flap 40, at its bottom by a frangible perforated line 66 and at its top by a fold line 65. The frangible perforated line 66 extends inwardly from the side edge 67 in substantially the middle of the closure flap 40. This line 66 extends above fold line 41 substantially the same distance that line 55 extends above fold line 37 in the first top closure flap 36. The fold line 65 extends from the upper left corner of flap 40 and intersects perforated line 66. The angle between side edge 67 and perforated line 66 is about 90 degrees, the angle between lines 65 and 66 is about 45 degrees and the angle between side edge 67 and line 65 is about 45 degrees. Thus, the fourth triangular area is in substantially the form of a right, isosceles triangle with line 65 being the hypotenuse.

As seen in FIG. 1, the area enclosed by each of the four triangular areas is substantially equal.

Figure 2:
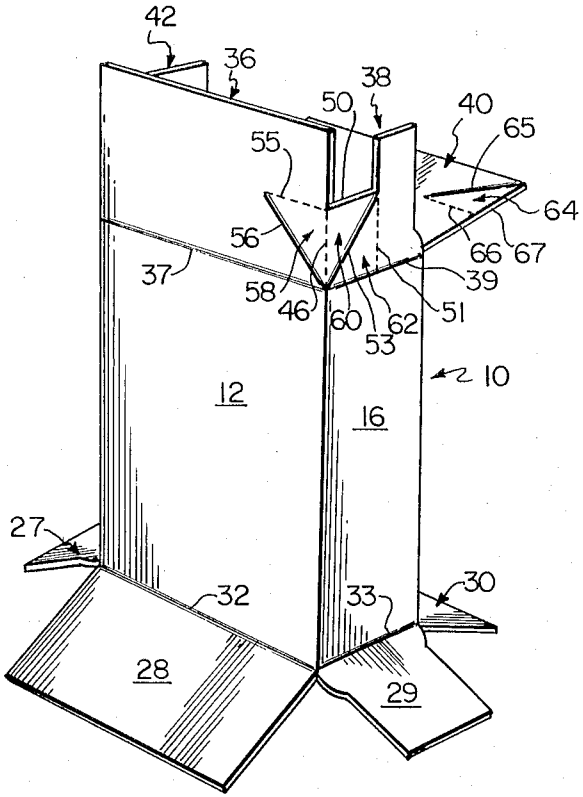
FIG. 2 is a left perspective view in front elevation of the container in accordance with the present invention which has been partially constructed to the extent that it forms a multi-sided body in the form of a sleeve, the top and bottom closure flaps not having yet been closed.

Referring now to FIG. 2, the blank 10 is shown in a position in which a container with a multi-sided body is formed in a sleeve configuration. This is accomplished by folding the panels 12, 14, 16 and 18 along their respective fold lines 20, 21 and 22 and also folding glue flap 24 along fold line 25 so that it contacts the edge of rear panel 14. A suitable adhesive, such as glue, is interposed therebetween so as to interconnect the panels in the sleeve configuration shown in FIG. 2. In forming the container, panels 12 and 14 are planar, and are opposed and parallel to one another. Panels 16 and 18 are planar, and are opposed and parallel to one another. Panels 12 and 14 are perpendicular to panels 16 and 18. The chamber enclosed by these panels has rectangular longitudinal and transverse cross-sections.

The bottom closure flaps 27, 28, 29 and 30 are next folded along their respective fold lines so as to suitably, and conventionally, close the bottom of the container formed by the multi-sided body. These bottom closure flaps are sealed by adhesive and are perpendicular to the panels.

This forming of the container and closing of the bottom closure flaps is readily accomplished by means of high speed automated equipment. Similarly, after the construction of the sleeve and closing of the bottom closure flaps, the contents of the container can be placed automatically into the interior thereof. This material can be granular or powdered substances.

Once this filling is accomplished, which can be done by high speed automated equipment, it is necessary to close the top of the container, which can also be done by high speed automated equipment.

As seen in FIGS. 3 and 4 the various steps required to close the top closure flaps of the container are illustrated, and in FIGS. 5–12, the manipulation of the various flaps is shown so as to open the pour spout formed therein.

Specifically referring to FIG. 3, the first step in closing the top of the container includes the folding inwardly, along fold line 39, of the second top closure flap 38 and a concurrent folding inwardly, along line 37, of the first top closure flap 36. It is noted that when these two flaps are so folded a hinging occurs along fold line 46 as well as fold line 53. This folding inwardly continues until the two flaps 38 and 36 are substantially perpendicular to the panels 12 and 16 and so that triangular area 60 is superimposed on triangular area 62 lying therebeneath. In this regard, triangular area 58 is also superimposed above and in contact with triangular area 60 therebeneath. Since fold line 46 is also perforated, the bending or hinging along that line is facilitated, as seen in FIG. 3, where the perforations expand somewhat upon bending of the two flaps involved. Although not seen in FIG. 3, it is noted that the second side panel top closure flap 42 is also folded inwardly to a position perpendicular to the panels. Adhesive is applied between the top closure flap 36 and the side panel closure flaps 42 and 38, except in the area between triangular areas 60 and 62.

As seen in FIG. 4, once the flap 36 fully overlies flap 38 and is perpendicular to panels 12 and 16, the third top closure flap 40 associated with the rear panel 14 is folded along fold line 41 inwardly into a perpendicular orientation relative to the rear panel 14 and overlying the now fully folded first closure flap 36. Adhesive is placed between flaps 36 and 40, including in the areas between triangular areas 64 and 58 if desired. As seen in FIG. 4, once flap 40 overlies flap 36, triangular area 64 will overlie triangular area 58.

Turning now to FIG. 5, the closed top of the container is shown in which the closing operation has progressed beyond that shown in FIG. 4 and flap 40 is in a fully overlying and contacting position with flap 36. It is in this position that the container and its contents are transported and sold to the ultimate consumer.

In order to open the pour spout a series of steps shown in FIGS. 6–8 are carried out, and in order to replace the spout to its closed position, these steps are reversed.

Thus, as seen in FIG. 6, first the frangible perforated line 66 is fully servered and the triangular area 64 is folded back along fold line 65. This is shown in FIG. 6 in which triangular area 58 is now exposed to view.

Next, as seen in FIGS. 7 and 9, frangible score line 55 is fully severed and the combination of triangular areas 58 and 60 are folded back along both of the fold lines 56 and 53 to expose triangular area 62. If areas 64 and 58 are adhered together, these two steps are combined into one step.

In order to open the spout, frangible perforated line 51 is fully severed and triangular areas 60 and 62 are pulled outward from the container so that they all pivot around a combination of fold lines 46, 53, and 39.

This is more clearly shown in FIGS. 10, 11 and 12 which show the ultimate configuration of the pour spout 70 formed by the combination of triangular areas 58, 60 and 62. The triangular area 64 lying adjacent and contacting triangular area 58 serves to reinforce and stabilize the spout 70 so formed.

At this time the contents of the container 10 can be poured from the inside thereof and out the spout 70 via the orifice 72 so formed. As best seen in FIG. 11, this orifice 72 is formed by the adjacent edges of triangular areas 62 and 58 as well as the three perforated lines 51, 55 and 66, most easily seen in FIGS. 8 and 10.

In order to return the pour spout to a closed position, the steps outlined above are reversed, resulting in a secure closure of the spout and a highly reliable maintenance of the contents of the container therein. The spout can be opened and closed numerous times without losing its effectiveness. In the closed position, triangular area 64 in the third top closure flap 40 helps to bias the spout in the closed position and maintain it closed to prevent inadvertent opening and loss of the container's contents.

While one advantageous embodiment has been chosen to illustrate the present invention, it will be understood by those skilled in the art that various changes and modifications can be made therein without departing from the scope of the invention as defined in the appended claims.

What is claimed is:

1. A container having an integrally formed spout comprising:

a front panel, two side panels and a rear panel connected along generally parallel fold lines to provide a multi-sided body;

a glue flap interconnecting two of said panels;

a bottom closure for said body connected to at least one of said panels;

first and second top closure flaps hingedly extending respectively along fold lines from the tops of two adjacent panels and extending perpendicular to said two adjacent panels;

said top closure flaps being integrally formed and having a fold line therebetween; and means, in said top closure flaps, defining three hingedly connected, superimposed triangular areas, said means including a first frangible perforated line in said first top closure flap and a second frangible perforated line in said second top closure flap, said triangular areas forming the spout once said frangible perforated lines are severed and said triangular areas are pulled outwardly from said multi-sided body.

2. A container according to claim 1, wherein one of said triangular areas is in said first top closure flap and the other two of said triangular areas are in said second top closure flap.

3. A container according to claim 2, and further including a third top closure flap hingedly extending along a fold line from the top of a third of said panels, extending perpendicular to said third panel and overlying said first top closure flap.

4. A container according to claim 3, wherein said third top closure flap has a triangular area defined therein by a frangible perforated line, a fold line therein and an outer edge thereof, said triangular area in said third top closure flap overlying said triangular area in said first top closure flap.

5. A container according to claim 4, wherein said triangular area in said third top closure flap is in the form of a right isosceles triangle.

6. A container according to claim 1, wherein one of said triangular areas is in said first top closure flap and is defined by said frangible perforated line in said first top closure flap, said fold line between said top closure flaps, and another fold line in said first top closure flap.

7. A container according to claim 6, wherein said frangible perforated line in said first top closure flap extends inwardly from an edge thereof adjacent said second top closure flap, and said another fold line extends from a corner of said first top closure flap.

8. A container according to claim 6, wherein said triangular area in said first top closure flap is in the form of a right isosceles triangle.

9. A container according to claim 8, wherein said another fold line is the hypotenuse of said triangular area.

10. A container according to claim, 1, wherein two of said triangular areas are in said second top closure flap.

11. A container according to claim 10, wherein a first of said two triangular areas in said second top closure flap is defined by said fold line between said top closure flaps, an outer edge of said second top closure flap and another fold line in said second top closure flap.

12. A container according to claim 11, wherein a second of said two triangular areas in said second top closure flap is defined by said frangible perforated line in said second top closure flap, said fold line between said second top closure flap and said panel from which it extends, and said another fold line.

13. A container according to claim 12, wherein said two triangular areas in said second top closure flap are each in the form of right isosceles triangles.

14. A container according to claim 13, wherein said another fold line is the hypotenuse of both of said two triangular areas in said second top closure flap.

15. A container according to claim 1, wherein said first top closure flap extends from said front panel, said third top closure flap extends from said rear panel, and said second top closure flap extends from one of said side panels between said front and rear panels.

16. A unitary blank for a carton having an integrally formed spout comprising:

a front panel;

first and second side panels hingedly extending from opposed sides of said front panel along fold lines;

a rear panel hingedly extending from one of said side panels along a fold line;

a glue flap hingedly extending from one of said side panels along a fold line;

at least one bottom closure flap hingedly extending from the bottom of at least one of said panels;

a front panel top closure flap hingedly extending from the top of said front panel along a fold line; and a side panel top closure flap hingedly extending from the top of one of said side panels along a fold line, said front panel top closure flap having a frangible perforated line extending inward from an edge adjacent said side panel top closure flap and having a fold line extending inward from a corner of said front panel top closure flap to intersect said frangible perforated line in said front panel top closure flap at an angle of less than 90°, said side panel top closure flap having a first and second portion with a frangible perforated line therebetween, said front panel and side panel top closure flaps being integral and having a fold line therebetween, said first portion having a fold line intersecting at angles of less than 90° said frangible perforated line between said first and second portions and said fold line between said front panel and side panel top closure flaps.

17. A unitary blank according to claim 16, wherein said angles are each about 45°.

18. A unitary blank according to claim 16, and further including a rear panel top closure flap hingedly extending from the top of said rear panel along a fold line, said rear panel top closure flap having a frangible perforated line extending inward from an edge adjacent said side panel top closure flap and having a fold line extending inward from a corner thereof to intersect said frangible perforated line therein at angle of less than 90°.

19. A unitary blank according to claim 18, wherein said angle of intersection between said fold line and frangible perforated line in said rear panel top closure flap is about 45°.

20. A unitary blank for a carton having an integrally formed spout comprising:

a front panel;

first and second side panels hingedly extending from opposed sides of said front panel along parallel fold lines;

a rear panel hingedly extending from one of said side panels along a fold line;

a glue flap hingedly extending from one of said side panels along a fold line;

four bottom closure flaps, each hingedly extending respectively from the bottom of one of said panels along a fold line first, second, third and fourth top closure flaps, each hingedly extending respectively from the top of one of said panels along a fold line;

said third top closure flap extending from said rear panel, having a frangible perforated line extending inward from an edge adjacent said second top closure flap extending from said first side panel, and having a fold line extending inward to intersect said frangible perforated line at an angle of less than 90°, said first top closure flap extending from said front panel, having a frangible perforated line extending inward from an edge adjacent said second top closure flap, and having a fold line extending inward to intersect said frangible perforated line in said first top closure flap at an angle of less than 90°, said second top closure flap having a first and a second portion with a frangible perforated line therebetween, said first and second top closure flaps being integral and having a fold line therebetween, said first portion having a fold line intersecting at angles of less than 90° said frangible perforated line between said first and second portions and said fold line between said first and second top closure flaps.

21. A blank according to claim 20, wherein said frangible perforated line between said first and second portions is substantially in the middle of said second top closure flap.

22. A blank according to claim 20, wherein the intersection of said fold line and said frangible perforated line in said third top closure flap is at an angle of about 45°.

23. A blank according to claim 20, wherein the intersection of said fold line and said frangible perforated line in said first top closure flap is at an angle of about 45°.

24. A blank according to claim 20, wherein the intersection of said fold line in said first portion with said frangible perforated line between said first and second portions and with said fold line between said first and second top closure flaps are each at angles of about 45°.

25. A container having an integrally formed spout comprising:

a front panel, at least one side panel and at least one additional panel connected along generally parallel fold lines to provide a multi-sided body;

a glue flap interconnecting two of said panels;

a bottom closure for said body connected to at least one of said panels;

first and second top closure flaps hingedly extending respectively along fold lines from the tops of two adjacent panels and extending perpendicular to said two adjacent panels;

said top closure flaps being integrally formed and having a fold line therebetween; and means, in said top closure flaps, defining three hingedly connected, superimposed triangular areas, said means including a first frangible perforated line in said first top closure flap and a second frangible perforated line in said second top closure flap, said triangular areas forming the spout once said frangible perforated lines are severed and said triangular areas are pulled outwardly from said multi-sided body.

* * * * *